United States Patent [19]

Wrhen

[11] Patent Number: 5,070,951

[45] Date of Patent: Dec. 10, 1991

[54] DRILL FOR WATER WELLS

[76] Inventor: Wilmer C. Wrhen, 4 Pinoak Cir., Oil City, Pa. 16301

[21] Appl. No.: 571,898

[22] Filed: Aug. 24, 1990

[51] Int. Cl.[5] ..... E21B 10/32; E21B 10/62

[52] U.S. Cl. ..... 175/288; 175/412; 175/424

[58] Field of Search ..... 175/286, 292, 263, 393, 175/424, 288, 284, 289, 412, 413

[56] References Cited

U.S. PATENT DOCUMENTS

| | | | |
|---|---|---|---|
| 654,164 | 7/1900 | Lawrence | 175/288 |
| 1,669,467 | 5/1928 | Harris | 175/286 X |
| 2,178,852 | 11/1939 | Dunlap, Jr. | 175/286 |
| 2,225,165 | 12/1940 | Dunlap, Jr. | 175/286 |
| 2,279,562 | 4/1942 | Dunlap, Jr. | 175/286 |
| 3,004,615 | 10/1961 | Schutte | 175/286 |

*Primary Examiner*—Stephen J. Novosad
*Attorney, Agent, or Firm*—Ralph Hammar

[57] ABSTRACT

A rotary well drilling unit, particularly for water wells, comprises a tubular rotatable drill string string through which water is pumped. Attached to the lower end of the drill string is a drill head having side-by-side cutter blades. The cutter blades are cammed radially outwardly to expand in diameter when the drill string is lowered to drill a hole sized to receive a well casing lowered behind the drill, and are cammed radially inwardly so as to contract in diameter to clear the casing when the string is lifted. The same drill may be used for drilling wells of different diameters by merely substituting cutter blades.

7 Claims, 2 Drawing Sheets

DRILL FOR WATER WELLS

Figure 1:
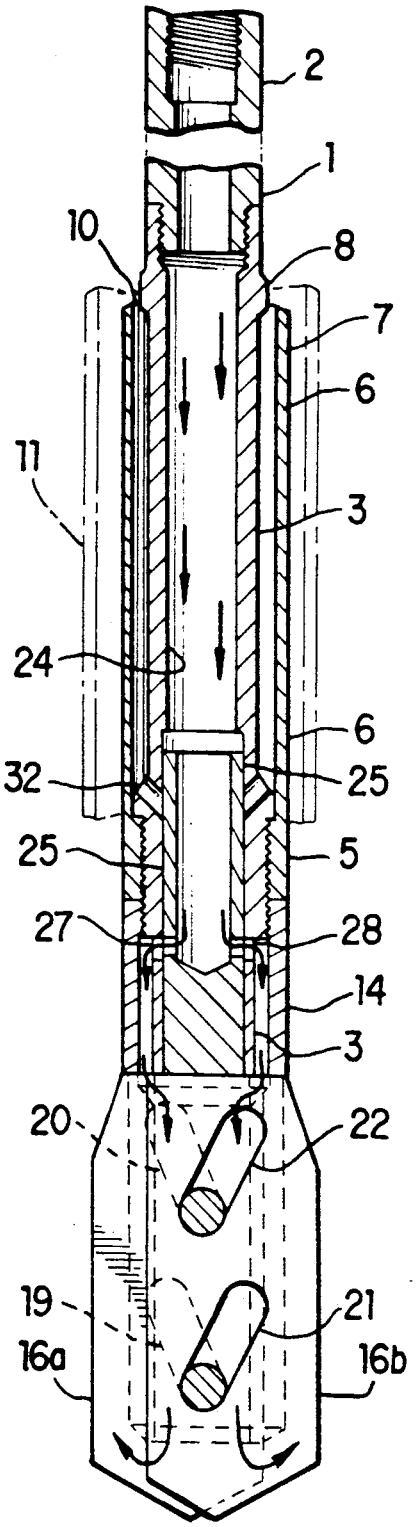

This invention is a rotary well drilling unit particularly adapted to water wells. During drilling, a drill string consisting of end-to-end sections of pipe is rotated while water under pressure is pumped down through the pipe. The water discharges through the lower end of the pipe and cooperates with a cutter to break or grind a hole in the earth and flush the cuttings back to the surface. To prevent loss of circulation by drilling through a porous formation, the diameter of the expanded drill is enough to receive a well casing which is lowered behind the drill to shut off porous formations. When lifted off bottom the drill retracts to pass through the casing.

The casing which shuts off porous formations will also shut off formations containing free water, the material for which the well is being drilled. If the well is drilled through a water bearing formation, that source of water is lost. It is therefore important that the presence of free water be detected when the well reaches a water bearing formation. This is accomplished by means for diverting the flow of water from the cutters to a jet pump structure which will carry the free water to the surface so the driller can see the increase in flow due to the addition of free water and stop drilling.

In the drawing,

FIG. 1 sectional elevation of the drill in the drilling mode.

Figure 1B:
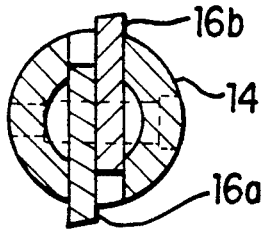
Figure 1A:
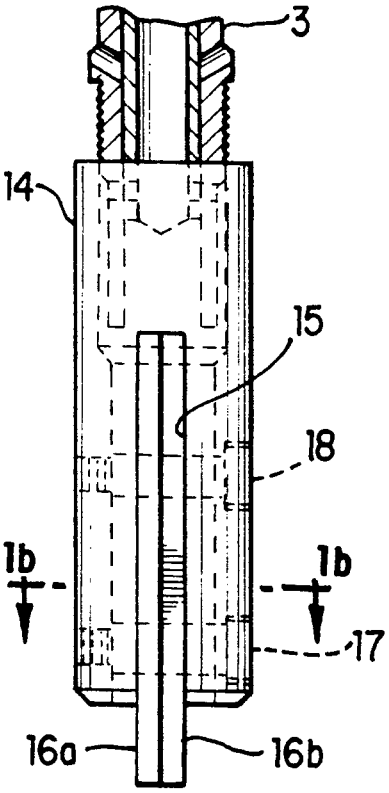

FIG. 1*a* is a side elevation of the lower end of FIG. 1

Figure 2:
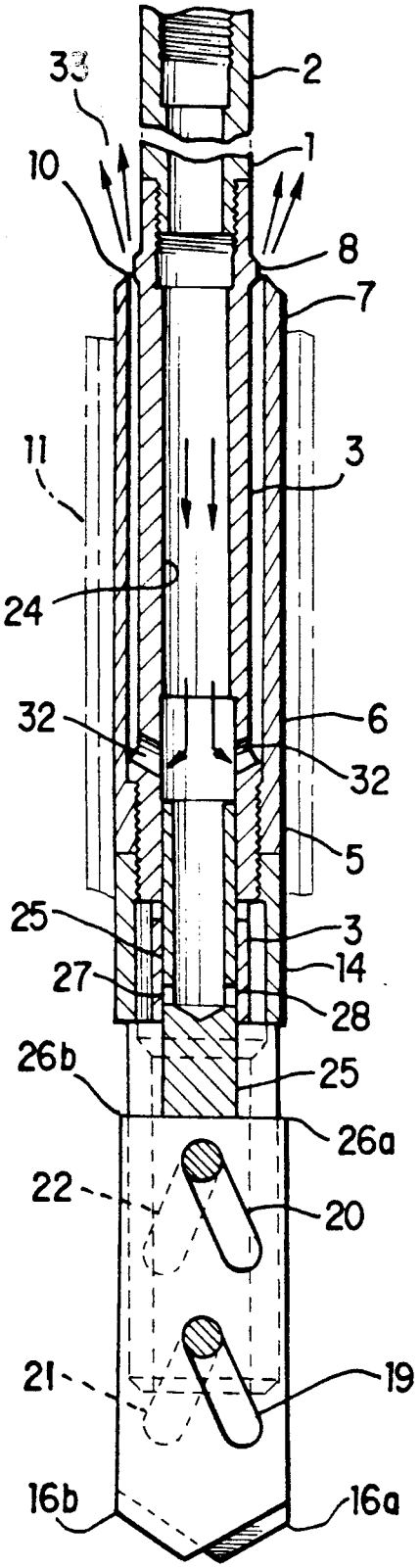
Figure 2B:
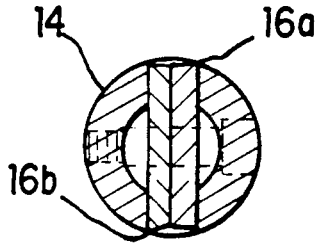
Figure 2A:
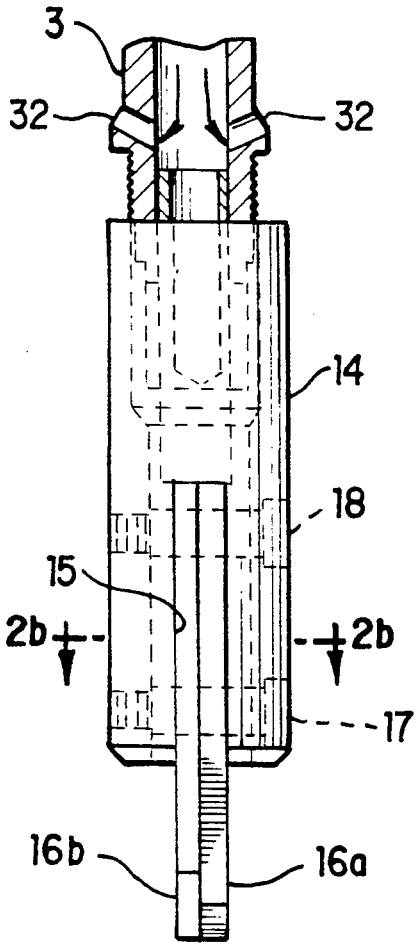

FIG. 1*b* a section on line 1*b*—1*b* of FIG. 1*a*,

FIG. 2 is a sectional elevation of the drill in the pumping or free water testing mode;

FIG. 2*a* is a side elevation of the lower end of FIG. 2, and

FIG. 2*b* is a section on line 2*b*—2*b* of FIG. 2*a*.

In the drawing, 1 indicates an adaptor having its upper end 2 screwed onto the lower end of the drill pipe string. The numeral 3 indicates a jet body having its upper end screwed onto the lower end of the adaptor 1. The lower end 5 of a sleeve 6 is screwed onto the lower end of body 3 and the upper end 7 of the sleeve 6 cooperates with annular projection 8 on the body to produce an upwardly directed annular nozzle 10. The nozzle 10 discharges to the space between well casing 11 and the adaptor 1 and creates a suction entraining any free water around the drill. If the drill has not entered a formation region containing free water, the amount of water returned to the top of the well casing will be equal to the amount of water which was pumped down through the drill pipe. If the drill has entered a formation containing free water, the amount of water returned to the surface will be greater than the amount of water sent down and will be an indication that the drill has struck water. This amount of water returned can be measured to provide a quantitative indication of the well capacity.

Drilling is done by drill head 14 having its upper end screwed on the lower end of jet body 3 and having its lower end provided with slot 15 to receive side-by-side cutters 16*a*, 16*b*. The cutter blades are retained in the slot 15 by shoulder screws 17, 18 respectively received in inclined slots 19, 20 in blade 16*a* and inclined slots 21, 22 in blade 16*b*. The slots 19, 20 are oppositely inclined with respect to slots 21, 22 and cooperate with the shoulder screws 17, 18 to cam the blades radially outward when the drill head is lowered relative to the blades and to retract the blades radially inward when the drill head is lifted relative to the blades. The blades expand and retract in unison.

Within the bore 24 of the jet body 3 is a valve member 25 which is held by gravity and fluid pressure against the upper ends 26*a*, 26*b* of the blades 16*a*, 16*b*. In the upper position of the valve the blades are in the drilling position and water flows through ports 27, 28 leading to the lower ends of the blades. The water picks up the cuttings and returns them to the surface.

In FIG. 2 which is the upper or pumping or testing position of the drill head, the drill head is raised by lifting the drill string and the cutter blades fall by gravity and by the pressure exerted by the water pumped down the drill pipe so that both cutters occupy the lowered position and the valve 25 blocks the ports 27, 28 leading from the drill head to the cutters. Under this condition the water pumped down the drill pipe flows through openings 32 and enters the space between the jet body 3 and the jet sleeve 6. Under this condition, if the drill has entered a formation containing free water, the upwardly discharged jets indicated by numeral 33 will create a suction on the free water and deliver it to the surface along with the water pumped down through the drill pipe string. The increase in flow will be an indication that the drill has struck water. The capacity of the well can be tested by measuring the accumulated difference between the water going down the pipe and the water being returned.

In the drilling mode when no lifting force is applied to the string, the weight of the drill string is sufficient to force the cutter blades upward relative to the pins 17, 18 as shown in FIG. 1 and the inclination of the slots 19, 20, 21, 22 causes the diameter of the hole cut by the bit to expand to the diameter the blades were designed to cut.

By changing the inclination of the slots 19, 20, 21, 22, the diameter of holes drilled can be changed. This permits the use of a drill for drilling several different holes of different diameters by merely changing blades without making any adjustments in the drill. This enables the drill to adapt to different pipe and coupling diameters; i.e., standard steel pipe, heavy or thin wall pipe, welded pipe, or plastic pipe.

Preparing To Drill Expansion Drill & Pump Combination

1. First be sure that the drill in its retracted position is small enough to fit loosely into the casing pipe.
2. In the expanded position, the blades should be dressed to fit the maximum size of the couplings or pipe being used.
3. To provide the best protection against loss of circulation and isolation of the best water supply, it is recommended that the bottom pipe be equipped with a collar or pipe of the largest size to be used. An adequate bevel on the leading edge is recommended. (the use of perforated pipes and bottom hole equipment is not recommended.)
4. Be sure to keep accurate records of total drill pipe lengths and casing length at all times. The relative position of the drill point and casing bottom is important.
5. Casing pipe should be cut to approximately the same lengths as the drill pipe to allow casing to be a minimum height above the surface pipe.

DRILLING INSTRUCTIONS EXPANSION DRILL & PUMP COMBINATION

1. After setting surface pipe and locating pump and mud pits, a check should be made with the drill immersed in the surface pipe to record the normal amount of water flow into the mud tank. (CAUTION! Remember --When drill is removed from the surface pipe, a "shower" of water will drench everything unless drilling pump is "turned off" previously.)
2. Drill or spud a hole inside the surface pipe deep enough to accept a length of casing plus about one foot.
3. Place a clamp on the casing which can support it, so that the bottom of the pipe is about a foot from the bottom of the hole when the pipe is inserted.
4. Insert the drill in the casing until the blades strike the bottom of the hole, attach pump and start water circulation to begin drilling.
5. Under normal drilling conditions, hole can be drilled until new drill pipe and casing can be added.
6. During normal drilling if the bottom formation seems to change, a test should be made to check for free water supply. This can be done by lifting the drill stem about 2", thus changing to the pump mode built into the drill.
7. If there is any indication of "free water", raise the drill stem to where the drill is again about one foot below the casing, and check the water flow into the mud tank. If the volume has increased, continue pumping to determine the flow available. With the drill in this position, the pump should increase the flow approximately 3½ gal. per minute, provided the free water supply is adequate.
8. If water supply is sufficient and water test pure, leave the casing where it is and plan your system.
9. If water is not usable, drop casing to within one foot of drill depth and re-check. This may block an unwanted supply and isolate a good supply. Further drilling may result in a better supply from the same strata, or deeper drilling may be required.
10. If deeper drilling is required, refer back to Item 5 and try again.

I claim:

1. A rotary drill head 14 having at its lower end a slot 15 receiving side-by-side cutter blades, upper and lower pins extending across said slot 15 and through upper and lower cam slots in each of said blades, each of said cam slots being inclined to the vertical to cam the blades radially outward upon lowering the head relative to the blades and to cam the blades radially inward upon lifting the head relative to the blades, the diameter of the hole drilled being determined by the inclination of the cam slots so the same drill may be used for drilling several different wells of several different diameters by merely substituting blades.

2. The structure of claim 1 in which the cam slots in each blade are parallel to each other.

3. A rotary drill having a depending tubular rotating string through which water is pumped, a drill head having cutters at the lower end of said string expanding when the string is lowered to drill a hole sized to receive a well casing lowered behind the drill, and contracting to clear the casing when the string is lifted, means for forming a return passageway around said string and within said casing for returning cuttings and water to the surface, means for forming upwardly directed jet means in said return passageway, and means for directing water from said string to said cutters when the string is lowered and for directing water from said string to said jet means when the string is lifted so the lifting of the string provides a test for the presence of free water at said cutters.

4. The structure of claim 3 in which the means for shifting the flow of water from said string between said cutters and said jet nozzle means comprises a slide valve body cooperating with ports leading to the cutters and to the jet means, the ports leading to the cutters being closed and the ports leading to the jet means being open during testing and the ports leading to the cutters being open and the ports leading to the jet means being closed during drilling.

5. The structure of claim 4 in which valve body is held against the upper edges of the cutters by gravity and water pressure.

6. A rotary drill head having at its lower end a slot receiving side-by-side cutter blades, upper and lower pins extending across said slot and through upper and lower cam slots in each of said blades, each of said cam slots being inclined to the vertical to cam the blades radially outward upon lowering the head relative to the blades and to cam the blades radially inward upon lifting the head relative to the blades.

7. The structure of claim 6 in which the pins are fixed to the head.

* * * * *